United States Patent [19]

Zahradnik et al.

[11] 3,994,426

[45] Nov. 30, 1976

[54] DRIVE MECHANISM FOR COMPUTER FORM FEEDER APPARATUS

[75] Inventors: George J. Zahradnik, Wheaton; Arthur A. Pudark, Downers Grove, both of Ill.

[73] Assignee: A. B. Dick Company, Chicago, Ill.

[22] Filed: May 15, 1975

[21] Appl. No.: 577,703

[52] U.S. Cl. ..... 226/51; 192/33 R; 192/71; 226/74; 226/178

[51] Int. Cl.[2] ..... B65H 17/38; B65H 79/00

[58] Field of Search ..... 226/51, 49, 178, 74; 192/71, 33 R, 33 C, 93 R, 43.1; 355/75

[56] References Cited

UNITED STATES PATENTS

| | | | |
|---|---|---|---|
| 2,762,477 | 9/1956 | Zenner | 192/71 X |
| 3,016,252 | 1/1962 | Mitchell | 192/71 X |
| 3,275,110 | 9/1966 | Lasky | 192/33 R X |
| 3,446,554 | 5/1969 | Hichcock et al. | 355/75 |
| 3,684,147 | 8/1972 | Ysbrand et al. | 226/178 |

*Primary Examiner*—Johnny D. Cherry
*Assistant Examiner*—Bruce H. Stoner, Jr.
*Attorney, Agent, or Firm*—Ronald J. LaPorte; Peter S. Lucyshyn

[57] ABSTRACT

A mechanism for driving a computer form web along a predetermined path includes a ratchet wheel having two sets of oppositely facing teeth, mounted on a support shaft for rotation. The wheel is driven in both clockwise and counter-clockwise directions. A drive gear in meshing engagement with a plurality of gears for driving the sprocket mechanism transporting the computer form web is also mounted on the support shaft for rotation. The gear is joined to a coupling plate also mounted on the support shaft for rotation thereon. The coupling plate includes first and second pawls which extend therefrom for cooperative engagement with the ratchet teeth sets, respectively. Pawl actuator arms also mounted on the coupling plate are movable to first and second positions and when in a first position engage the pawls to maintain the latter out of engagement with respective ratchet teeth sets. Pawl actuator arm engaging levers are mounted adjacent the pawl actuator arms and are movable to first and second positions. When in the first position the levers engage the pawl actuator arms to maintain them in the first position. Movement of the lever arms to the second position permits the pawls to be moved toward the ratchet wheel. Control of movement of the lever arms in turn controls the number of revolutions of the drive gear and thus the extent of movement of the computer web along its path. A manually operated gear selector for providing a change in gear ratios controls the length of movement of the computer web for each revolution of the drive gear. Continual rotation of the drive gear can be achieved by maintaining the lever arms in the second position.

15 Claims, 6 Drawing Figures

DRIVE MECHANISM FOR COMPUTER FORM FEEDER APPARATUS

BACKGROUND OF THE INVENTION

This invention relates generally to apparatus for feeding segmented webs of paper or the like material, such as, for example, computer printout forms, and more particularly to a forward-reverse drive mechanism for controlling the feeding of such material.

With the increased use of computers for storage and retrieval of information, hard copy computer printouts on fan fold or segmented paper webs are becoming more prevalent. The need for providing inexpensive copies of such printouts has also increased. One way to provide an inexpensive copy thereof is through the use of an electrostatic or the like copier. Manually feeding the segments of a computer printout web to the platen of a copier, however, becomes difficult and time-consuming. As such, apparatus for feeding computer forms to the original document platen of an electrostatic or the like copying machine has been made available. With such apparatus, the segmented or fan fold computer form web which is normally folded in accordion fashion so that the individual segments can be stacked, is sequentially unfolded and fed from a first station to the original document platen of the copying machine. From there the web is fed to a second station where it is refolded and stacked. With a computer form feeder of the type described, it is possible to feed the paper so that single segments are indexed to the original document platen automatically in a forward or reverse direction. If it is desired, the operation of the copying machine can be controlled by the operation of the computer form feeder so that each time a segment of the computer printout form is fed to the platen, the copier is operated to make one or more copies of that particular segment.

To be able to transport the computer printout web as described, an efficient drive mechanism must be provided. Such a drive mechanism must be capable of functioning to propel the computer printout web incrementally in both forward and reverse directions, to position precisely successive segments of the web onto the platen as well as in a continuous feed mode when it is desired to copy only selected segments of the web.

SUMMARY OF THE INVENTION

Accordingly, it is an object of the present invention to provide a drive mechanism which can be operated to drive a work piece incrementally in first and second directions as well as to operate in a continuous drive mode in both directions.

It is another object of the present invention to provide a drive mechanism of the above-described type which is suitable for use in a computer form feeder used in conjunction with a copying machine for transporting a computer printout web incrementally or continually between first and second stations to the original platen of the copying machine, in both forward and reverse directions.

It is still another object of the present invention to provide a drive mechanism of the above-described type which is relatively simple in construction, yet efficient in operation and low in manufacturing cost.

Briefly, a preferred embodiment of a drive mechanism according to the invention comprises a ratchet wheel mounted on a support shaft for rotation thereabout. The ratchet wheel has two sets of oppositely facing ratchet teeth provided circumferentially thereabout which are axially spaced from each other. The ratchet wheel is driven rotatably, continually about the shaft in a clockwise or counter-clockwise direction by a reversible drive motor coupled thereto.

A coupling plate is mounted axially adjacent to the ratchet wheel on the shaft for rotation thereon. The coupling plate includes a pair of opposing pawls pivotally mounted thereon. The pawls are provided for engagement with respective ratchet teeth sets of the ratchet wheel thereby to impart rotation to the coupling plate. Also mounted on the plate for pivotal movement is a pair of pawl actuator arms, one for each of the pawls. The actuator arms are geared together for simultaneous movement.

A pair of lever arms is pivotally mounted at first ends thereof on opposite sides of the coupling plate on support shafts. Each lever arm includes at the opposite end, a stop portion for engaging a roller extending outwardly from a first end of a respective one of the actuator arms. The lever arms are biased toward the actuator arms to normally engage the rollers when the coupling plate is at a first rotational position on the support shaft, thereby maintaining the actuator arms in a first position. When the actuator arms are in the last-mentioned position, the opposite ends thereof engage corresponding pawls to hold them away from corresponding ratchet teeth sets of the ratchet wheel.

The armature of a solenoid is coupled to the lever arms. Upon operation of the solenoid, the lever arms are moved against the biasing force applied thereto. The lever arm stop portions are removed from engagement with the rollers of the actuator arms, freeing the last-mentioned arms for pivotal movement to a second position whereby the pawls are released for pivotal engagement with respective ratchet teeth sets. Depending upon the direction of rotation of the ratchet wheel at the particular time of release of the pawls, one of the pawls engages a tooth of a corresponding ratchet teeth set. The engagement of the pawl with the ratchet tooth, imparts rotation to the coupling plate. The actuator arms and pawls mounted on the coupling plate are carried along therewith. Rotation of the plate in turn imparts rotation to a stepped gear joined thereto and also mounted for rotation about the support shaft. The stepped gear drives two idler gears, either one of which may be positioned for engagement with a pinion coupled to a first drive shaft of the computer form feed drive sprocket arrangement. The length of web moved along its path of travel for each revolution of the stepped gear is controlled by the selective engagement of one or the other of the idler gears with the pinion.

Deactuation of the solenoid prior to a single revolution of the coupling plate permits the lever arms to be returned to a normal position. Rotation of the coupling plate a full revolution brings the actuator arms to their original position whereat a roller extending from one of the arms (depending upon the direction of rotation) is engaged by a corresponding stop portion of a respective lever arm. Engagement thereby causes the actuator arms to be returned to the first position, disengaging the one pawl from the ratchet tooth on the ratchet wheel. This discontinues the rotation of the stepped gear and in turn movement of the computer printout form along its path.

Reversing the direction of rotation of the drive motor imparts reverse rotation to the ratchet wheel and as such drives the computer form web in the opposite direction. Continual rotation of the coupling plate and stepped gear can be achieved by maintaining the solenoid actuated. When this occurs, the lever arms are held out of engagement with the rollers on the actuator arms and as such the engaged pawl and ratchet tooth remain in engagement until the solenoid is deactuated.

DETAILED DESCRIPTION OF THE DRAWINGS

Figure 1:
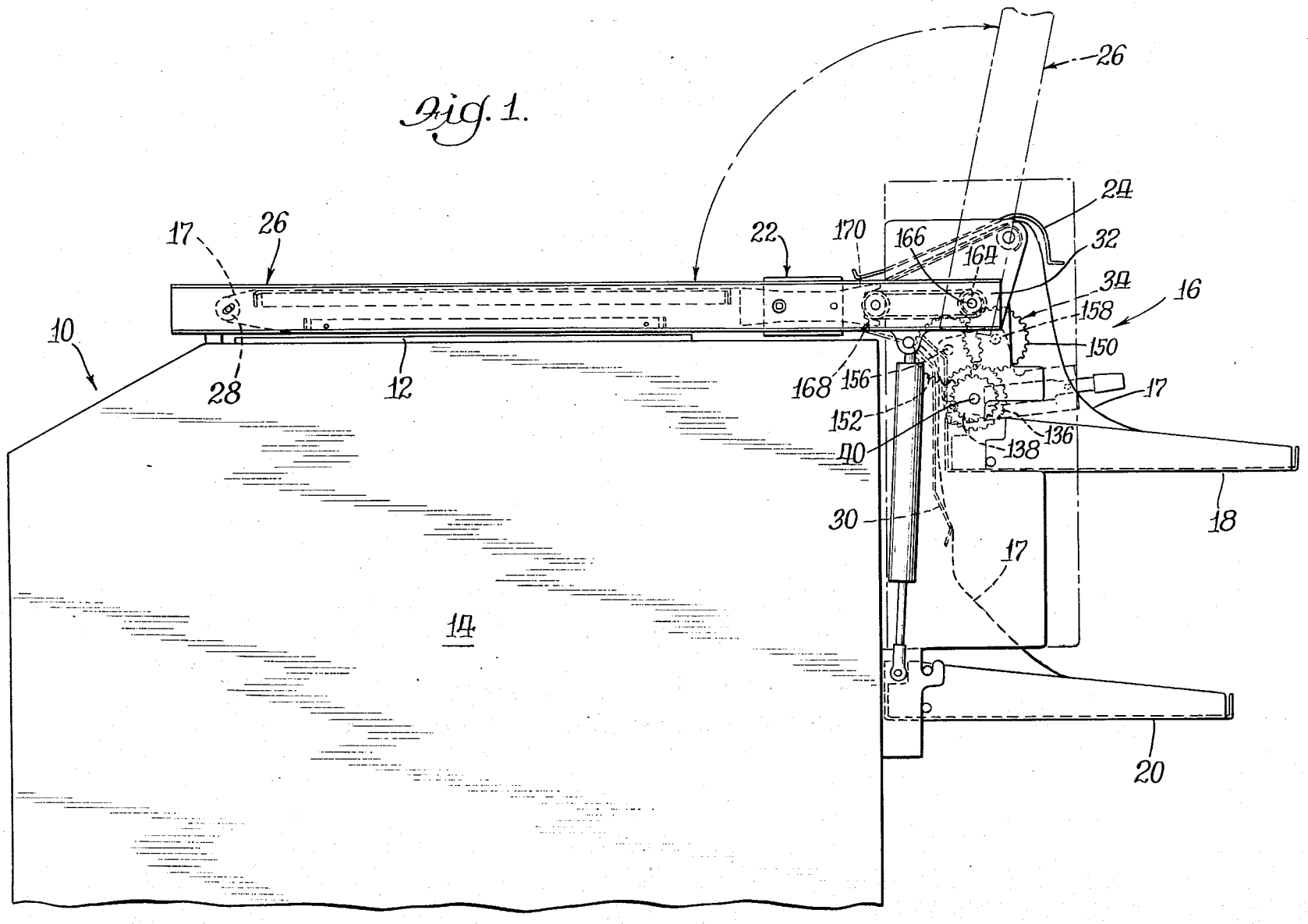
FIG. 1 is a side view of an electrostatic type copying machine having a computer form feeder mounted thereon for conveying computer printout forms to the original document platen of the machine for copying, which includes a drive mechanism according to the invention.

Referring now to the drawings in greater detail wherein like numerals have been employed to designate similar components throughout the various views, there is illustrated in FIG. 1 a copying machine designated generally by the numeral 10. The copying machine shown herein is of the electrostatic or xerographic type, but can take any form so long as it is capable of producing copies on paper, microfilm or other similar record medium. The copying machine 10 includes an original document glass platen 12 located along the upper wall thereof on which materials to be copied are placed. Conventional instrumentalities (not shown) for producing copies are included within the outer housing 14 of the machine.

A feeder apparatus 16 is mounted on the copying machine 10 for conveying a computer form or fan fold web 17 between supply trays 18, 20 to the original document platen 12 of the copying machine. Computer form webs which conventionally comprise a plurality of paper sheet segments connected together in edge to edge fashion and folded back on each other in accordion fashion for stacking, are placed in tray 18. The web which conventionally has a series of drive holes (not shown) provided along the edges thereof, is fed via a pair of sprocket drive devices such as 22 from the tray through a first chute 24, devices 22, over the top surface of a copyboard 26, about roller 28 mounted at the free end of the copyboard, along the lower surface of the copyboard, into a second chute 30 and to tray 20. A computer form web can be driven in both directions between the trays 18, 20, incrementally or continually to align selected segments or sheets thereof on platen 12 for copying. The copyboard 26 is pivotal about end 32 thereof from the position on platen 12 to a raised position shown in dotted lines to provide access to the original document platen 12 when making copies from originals other than the computer form web and for easy "threading" of the web about the copyboard. A more detailed description of the computer form feeder apparatus can be obtained from co-pending U.S. patent application Ser. Nos. 577,704 and 577,705, filed on the same date as the subject application and assigned to the same Assignee.

The drive mechanism 34 according to the invention, used to drive the sprocket drives 22 and as such feed the computer form web 17 as described, is shown in greater detail in FIGS. 2–6 of the drawings.

Referring to FIGS. 2–6, the drive mechanism 34 comprises a pair of support or end plates 36, 38 between which there is mounted a support shaft 40. A pulley wheel 42 having a central hub 44 is mounted on shaft 40 for rotation thereabout. Coupled to hub 44 for rotation with pulley wheel 42 is a ratchet wheel 46. The ratchet wheel 46 includes two sets of axially spaced, oppositely facing ratchet teeth 48, 50, extending circumferentially about the wheel. A drive motor 50 operable in both clockwise and counter-clockwise directions of rotation is mounted on support plate 36 and has a pulley wheel 52 mounted on the motor drive shaft 54. Endless belts 56, 57 extend about the pulley wheels 52 and 54 providing a driving force from motor 50 to the pulley wheel 42.

Also mounted on support shaft 40 for rotation thereabout is a coupling plate 58. The plate is spaced axially from the ratchet wheel 46 and held in a predetermined relation with respect thereto by means of spacer 60 mounted on shaft 40 coupled to coupling plate 58 for rotation therewith.

Figure 5:
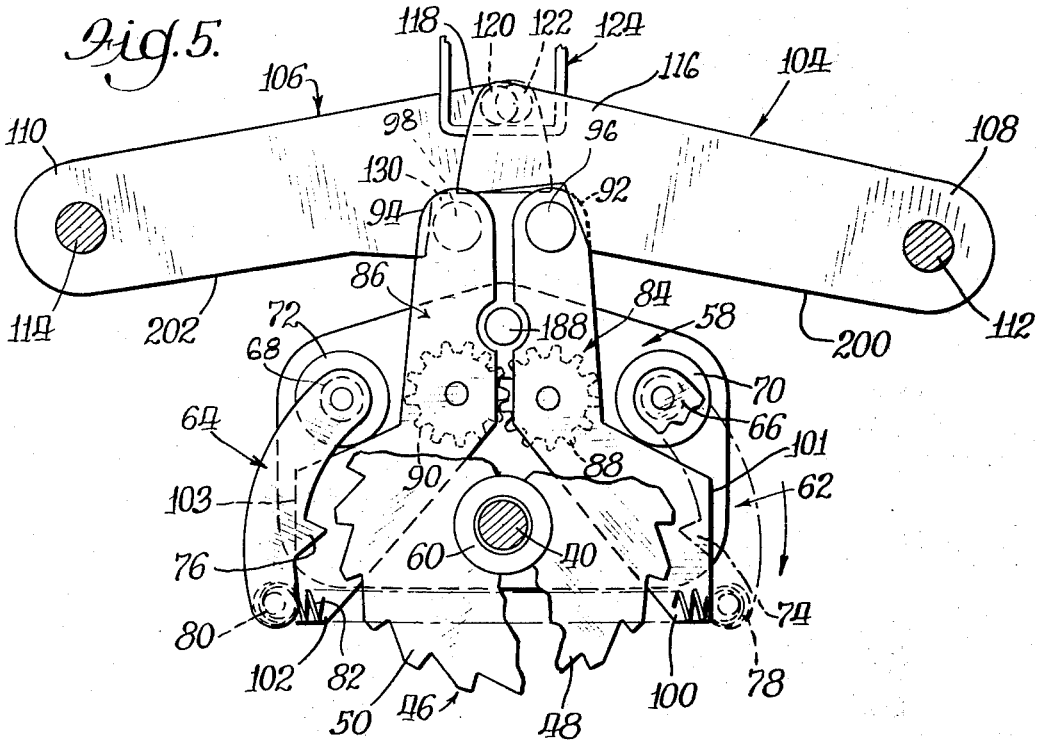
FIGS. 5 and 6 are partially fragmented side plan views of the coupling plate, ratchet wheel and lever arm arrangement of the drive mechanism according to the invention as they appear in decoupled and coupled conditions.
Figure 6:
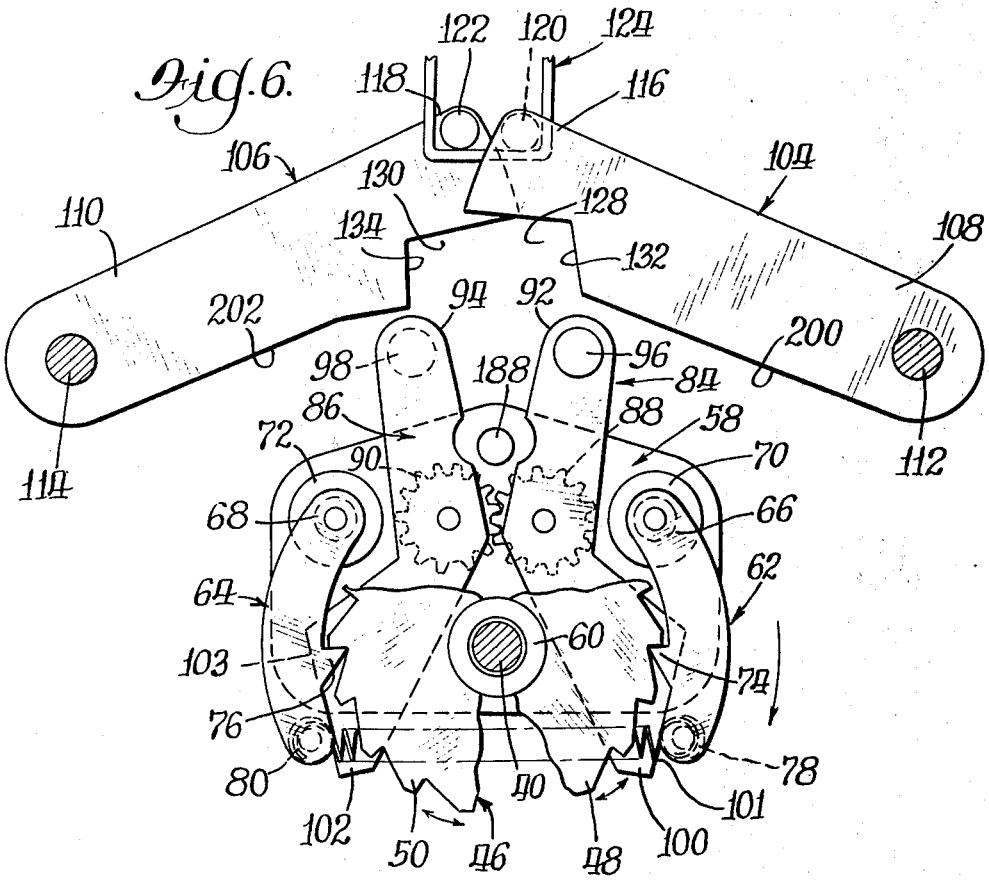

Mounted on coupling plate 58 near an end thereof opposite the axis of rotation of the plate on shaft 40, is a pair of opposing pawls 62 64 (See FIGS. 5 and 6). The pawls are arcuately shaped and are mounted for pivotal movement at first ends, 66, 68 thereof, respectively, on mounting pieces or spacers 70, 72, respectively, extending perpendicularly outwardly from the plate 58 toward the ratchet wheel. The pawls are aligned with respective ratchet teeth sets 48, 50 of ratchet wheel 46 so that pawl teeth 74, 76 of the corresponding pawls 62, 64, are positioned for cooperative engagement with the teeth sets. Rollers 78, 80 extend from the free ends of pawls 62, 64, respectively, perpendicularly thereto, in the direction of coupling plate 58. A coil spring 82 attached to the free ends of the rollers 78, 80 biases the pawls toward respective ratchet teeth sets on ratchet wheel 46.

Also mounted on coupling plate 58 between the pivotally mounted ends of pawls 62, 64 is a pair of pawl actuator arms 84, 86 (See FIGS. 5 and 6). Each pawl actuator arm is mounted near the center thereof on the coupling plate 58 adjacent the ends of the pawls also mounted on plate 58. The actuator arms are mounted on pinions 88, 90, which are in meshing engagement and rotatable with pivotal movement of the actuator arms. The pinions provide simultaneous movement of the actuator arms when one or the other thereof is pivoted.

Figure 2:
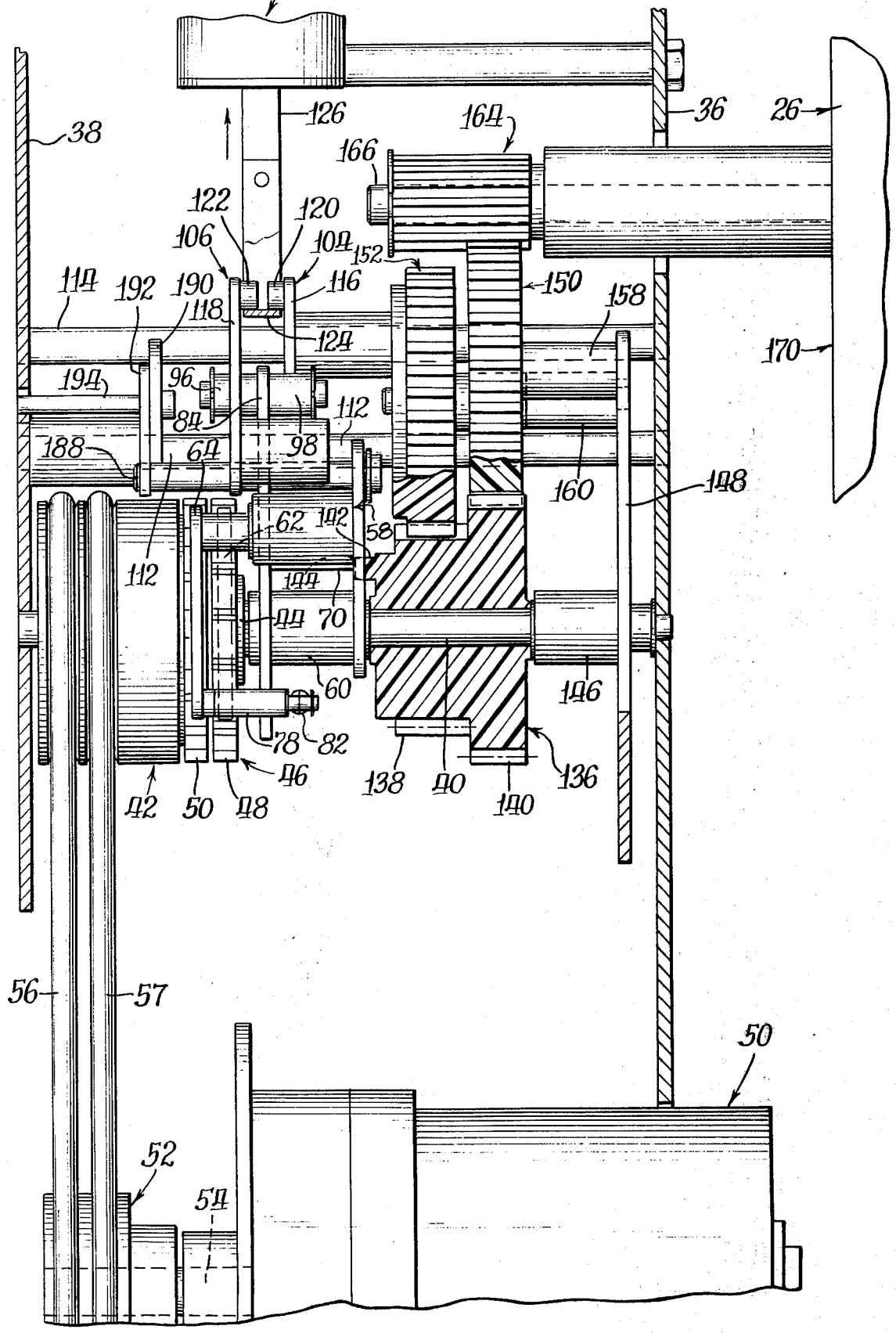
FIG. 2 is a side, partially sectioned view of the drive mechanism employed in the computer form feeder of FIG. 1.

First ends 92, 94 of the actuator arms extend outwardly beyond the end of coupling plate 58 and each has a roller member 96, 98, respectively, extending therefrom. As seen in FIGS. 2, 5 and 6, the roller members 96, 98 extend perpendicularly to the actuator arms in opposite directions therefrom. The opposite ends 100, 102 of the actuator arms 84, 86, respectively, extend toward the free ends of respective pawls 62, 64 for engagement with rollers 78, 80 thereof. Each end 100, 102 of the actuator arms is provided with a flat, cam edge 101, 103, respectively, for engaging rollers 78, 80, respectively, during operation of the drive mechanism. Upon movement of first ends 92, 94 of the actuator arms away from each other, the opposite ends 100, 102, thereof, are moved toward each other. This movement as will be described hereinafter, permits the pawls to be moved toward respective ratchet teeth sets of the ratchet wheel due to the force provided by biasing spring 82.

A pair of lever arms 104, 106 are provided to control the operation of the actuator arms 84, 86 and thus the pawls 62, 64. Each of the lever arms is mounted for pivotal movement at a first end 108, 110 on support shafts 112, 114, respectively, extending between support plates 36, 38 (See FIG. 4). A bearing member 107, 109 for each of the lever arms is present on respective shafts 112, 114 to provide proper rotation of the lever arms thereon.

The free ends 116, 118 of the lever arms are in opposing relation and extend in parallel alignment with respect to each other. The lever arms are biased toward actuator arms 84, 86 by springs 115, 117 mounted on shafts 112, 114, respectively. First ends 115*a*, 117*a*, of the springs are coupled to the lever arms and the opposite ends 115*b*, 117*b*, are held against pins 121, 123, respectively, extending from support plate 38 (shown in FIG. 3) for the purpose of tensioning the springs. Pins 120, 122 extend from each of the lever arms, perpendicularly thereto and toward each other for engagement by the U-shaped end 124 of the armature 126 of a solenoid 128 (See FIG. 2) provided to pivot the lever arms against the force of the biasing springs, thereby to release the actuator arms and operate the drive mechanism 34.

A cutout section 128, 130, is provided at the free end of each of the lever arms 104, 106, respectively. Stop or roller engaging surfaces 132, 134 are formed by the cutouts at the end of respective lever arms. When in the position shown in FIG. 5, the stop surfaces of the lever arms engage corresponding rollers 96, 98 of the actuator arms 84, 86 to maintain the actuator arms in a first position whereby ends 100, 102 are moved away from each other to force pawls 62, 64 away from respective ratchet teeth sets on the ratchet wheel 46.

Also mounted on support shaft 40 for rotation thereabout is a stepped drive gear 136 (See FIG. 2). The gear comprises two integrally formed gears 138, 140, which are of different diameters. The different gear diameters, permit the feeding of computer form webs which comprise two different lengths of interconnected sheet segments to be fed by the computer form feeder apparatus 16 so that the individual sheet segments are aligned properly on the copy platen of the copying machine. The gear 136 is joined to coupling plate 58 by means of a pin 142 extending from the body of the gear into an aperture 144 in plate 58. Thus, when coupling plate 58 is rotated about shaft 40, gear 136 likewise is rotated. A spacer-bearing 146 is provided on shaft 40 between the opposite end of gear 136 and support plate 36 to maintain gear 136 properly positioned on the shaft.

Mounted on spacer-bearing 146 for pivotal rotation therewith on shaft 40 is a support plate 148 upon which is mounted first and second idler gears 150, 152. In the preferred embodiment of the apparatus, the idler gears have a like number of gear teeth and are of the same diameter. The idler gears are mounted for rotation about support pins 154, 156, respectively, extending from plate 148 and are held outwardly from plate 148 by respective spacers 158, 160, for meshing engagement with one of gears 138, 140, respectively, of the stepped gear 136.

A manually maneuverable gear selector assembly 162, (See FIG. 3) extends from support plate 148 to permit an operator to pivot plate 148 between two operating positions whereby one or the other of the idler gears 150, 152 is brought into meshing engagement with a pinion gear 164 mounted on a support shaft 166 for rotation thereon. The pinion gear 164 extends through plate 36 into the side wall 170 of the computer form feeder copyboard 26. The pinion gear 164 is coupled through other instrumentalities (not shown) to the sprocket drive devices. Rotation of the pinion gear provides the driving force for the drive sprocket devices, thereby to feed computer form webs such as 17 along copyboard 26 between trays 18, 20.

Figure 3:
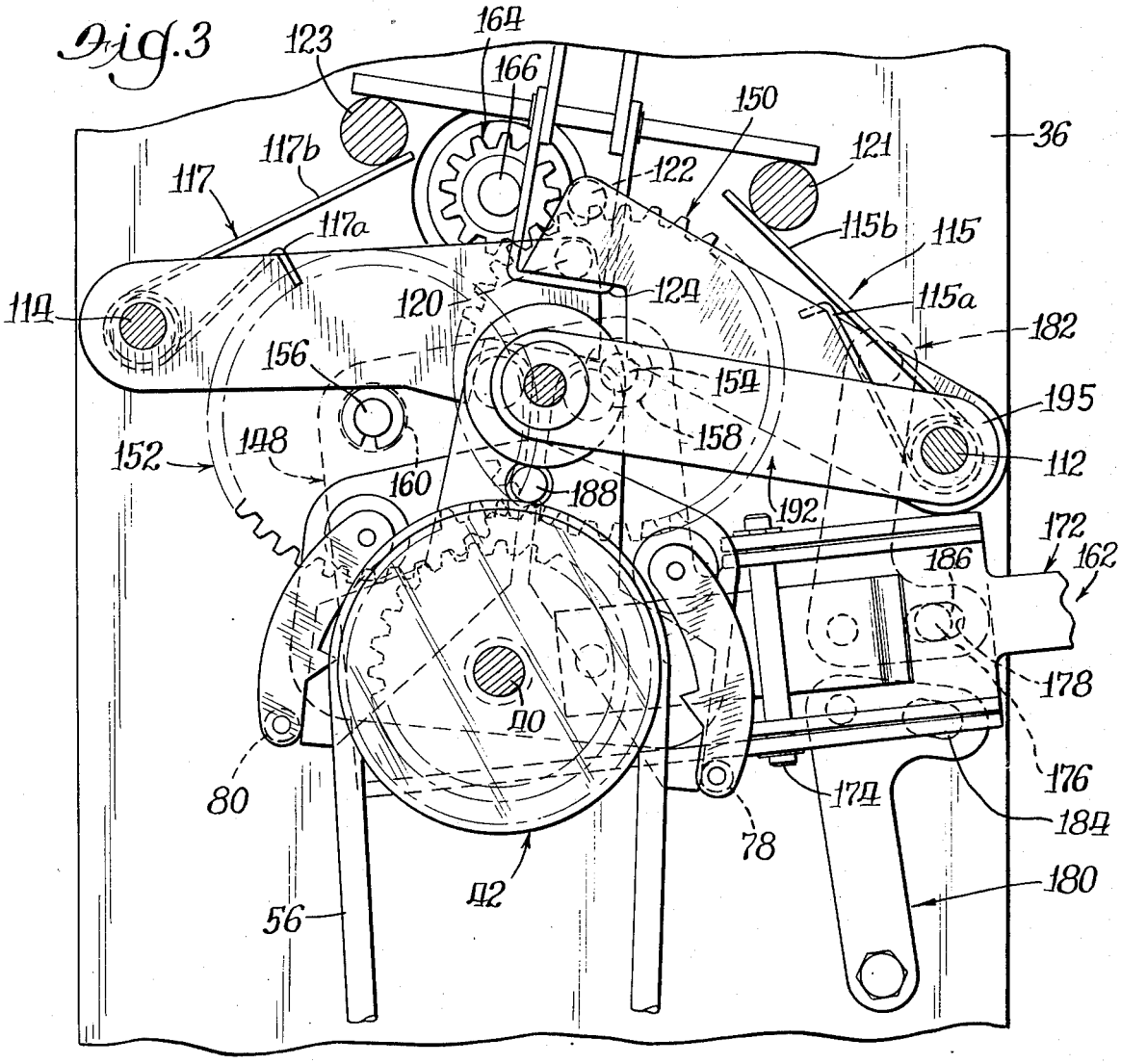
FIG. 3 is a side plan view of a portion of the drive mechanism of FIG. 2.
Figure 4:
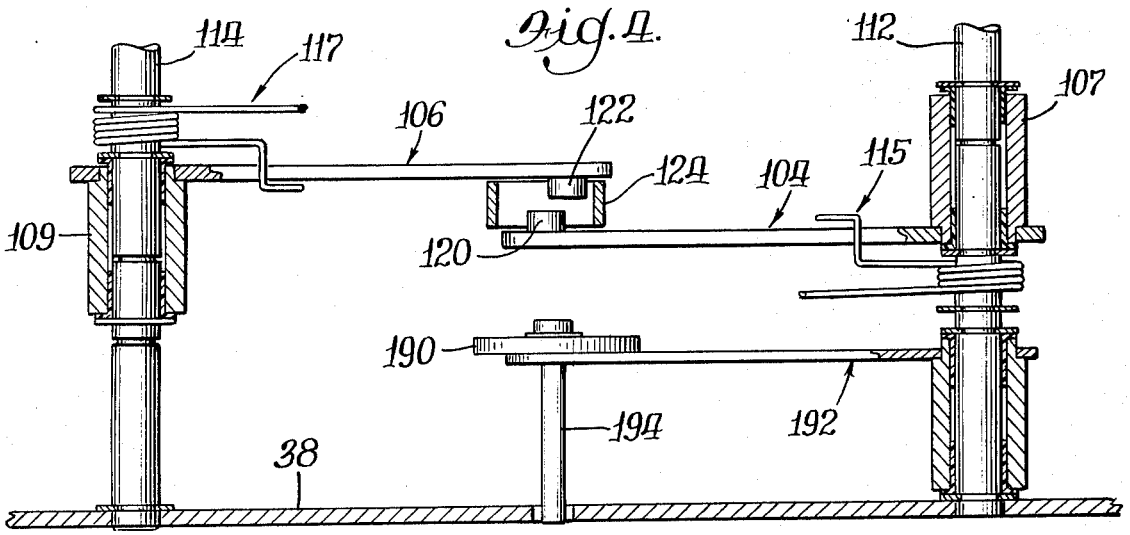
FIG. 4 is a top view of the lever arm and switch actuating arrangement of the drive mechanism of FIGS. 2 and 3.

The gear selector assembly 162 includes a locking handle 172 provided to maintain one or the other of idler gears 150, 152 in driving engagement with pinion 164. The handle 172 is coupled to the support plate 148 by a pin arrangement 174 for pivotal movement with respect to the plate. A pin 176 extending from the handle passes through a slotted aperture 178 in the support plate 148. Mounted on support plate 36 (See FIG. 3) adjacent the support plate 148 is a pair of pin receiving tabs 180, 182, each having a pin receiving slot 184, 186, therein. Pin 176 is shown inserted in slot 186 of tab 182 and as such idler gear 150 is placed into driving engagement with pinion 164. To change idler gears, handle 172 is pivoted about pin 174 away from support plate 148 to remove pin 176 from within slot 186. Thereafter, the plate 148 is rotated about shaft 40 (clockwise as shown in FIG. 3) until pin 174 is aligned with slot 184. At that time, the handle is pivoted toward support plate 148 to insert pin 176 into aperture 184. This movement causes the idler gear 152 to be moved into meshing engagement with pinion 164.

In addition to carrying the pawls and actuator arms as described, coupling plate 58 also carries an elongated pin member 188 which extends perpendicularly therefrom between ends 92, 94 of the actuator arms. The pin member is provided for engagement with a roller 190 mounted for rotation on the free end of a lever arm 192 (See FIGS. 2 and 3). The lever arm 192 is mounted at the opposite end 195 thereof on support shaft 112, also carrying lever arm 104. Extending from the lever arm 192 outwardly from the surface thereof opposite roller 190 is an actuating pin 194. The pin 194 is provided for actuating a switch (not shown) mounted on support plate 38, each time the coupling plate and stepped gear make a single revolution. The switch can be used for operating the copying machine automatically each time a computer form web segment is fed to the copy platen or to count segments of the web, etc.

In operation, the drive motor 50 is energized upon operation of an on/off switch (not shown) of the computer form feeder apparatus 16. The motor 50 can be operated for rotation both in clockwise and counterclockwise directions and as such the drive shaft thereof will be turning in one or the other of such directions during operation of the feeder apparatus. The motor, through belts 56, 58, drives pulley 42 and ratchet wheel 46 in a corresponding direction of rotation.

When it is desired to index the computer form web 17 to move a segment thereof into position over the platen 12 of copying machine 10, solenoid 128 is energized. The latter may be accomplished manually or in accordance with the operation of the copying machine, automatically through suitable circuitry (not shown). To provide incremental movement of the web 17, the solenoid need only be energized momentarily. This permits the armature 126 of the solenoid to pull-in, in the direction of the arrow as seen in FIG. 2. The latter operation causes lever arms 104, 106 to be lifted from the position shown in FIG. 5 to that shown in FIG. 6, away from rollers 96, 98 of actuator arms 84, 86, thereby releasing the actuator arms. This in turn permits spring 82 connecting the free ends of pawls 62, 64 to urge the latter toward respective teeth sets of ratchet wheel 46. Movement of the pawls in this fashion causes rollers 78, 80 thereof to pivot the actuator arms 84, 86, respectively, forcing ends 92, 94 thereof apart (See FIG. 6).

Depending upon the direction of rotation of the ratchet wheel, one or the other of the teeth 74, 76 of the pawls will engage a tooth on a corresponding ratchet teeth set to couple the coupling plate 58 to the rotating ratchet wheel 46. Rotation of the coupling plate causes the stepped gear 136 to be rotated in a like direction about shaft 40. In turn, idler gears 150, 152 which are in meshing engagement with stepped gear 136 are driven rotatably in the opposite direction.

Depending upon the slot 184, 186 in which pin 176 of selector handle 172 is inserted, one or the other of the gears 150, 152 is placed in meshing engagement with pinion 164. The pinon is driven rotatably to turn sprocket drive 22. As mentioned heretofore, the selection of one or the other of the idler gears 150, 152 for meshing engagement with pinion 164 provides the feeding of a corresponding length of computer form web 17 toward copy platen 12 for a single revolution of stepped gear 136.

If the solenoid is deenergized prior to a full revolution of segmented gear 136, the lever arms 104, 106 are returned to their first (normal) positions by means of biasing springs 115, 117, respectively. Accordingly, as rollers 96, 98 of actuator arms 84, 86 are revolved about to a home or starting position as shown in FIG. 5, the trailing roller, depending upon the direction of rotation of the coupling plate, engages one of the lower edges 200, 202 of a corresponding lever arm. Assuming the coupling plate is being rotated in the direction of the arrow shown in FIGS. 5 and 6, roller 98 of arm 86 engages surface 202 of lever arm 106. Engagement of the lever arm as described pivots the arm against the biasing spring 117 away from the rotating coupling plate 58, permitting the roller 98 to pass by the lever arm 106. During this time, the roller 96 engages stop 132 of lever arm 104. The engagement of stop 132 holds the actuator arm against further movement in the direction of the arrow. However, coupling plate 58 continues to rotate momentarily. Movement of the actuator arm 84 as described causes, through pinions 88, 90, end 94 of actuator arm 86 to be moved toward end 92 of actuator arm 84 and in turn moves the opposite ends 100, 102 of the actuator arms into engagement with rollers 78, 80 of pawls 62, 64, respectively. The latter motion drives the pawls away from corresponding ratchet teeth sets of the ratchet wheel 46 to disengage the engaged pawl from a corresponding teeth set. (In the case of rotation in the direction of the arrow shown, pawl 62 is disengaged from the gear teeth set 50).

Disengagement of the pawl from the ratchet wheel teeth set stops the rotation of coupling plate 58 at its initial position. With ends 92, 94 of the actuator arms moved together as shown in FIG. 5, lever arm 106 is able to be returned to its normal position by the action of spring 117 thereby to recapture the rollers 96, 98 between stops 132, 134 of the lever arms 104, 106.

As described heretofore, for each revolution of the stepped gear 136, the sprocket devices 22 transport the computer form web a predetermined distance along its path of travel between trays 18, 20. Through the use of idler gears 150, 152, the length of travel of the form for each revolution of the stepped gear can be altered to two preselected distances. These lengths of travel have been chosen through the selection of gear diameters, etc., to match the lengths of individual segments of the two most commonly used computer form webs. Thus, once a segment of the web is mounted on the copyboard in proper alignment, each revolution of the stepped gear member 136 thereafter provides a proper indexing of the web to move succeeding segments into alignment on the copy platen for copying.

To provide continual feeding of the computer form web 17 past platen 12 and between the feed trays 18, 20, the solenoid 120 is maintained energized. In this case, the armature 126 thereof is held in a pulled-in condition, thereby maintaining lever arms 104, 106 in the operated position shown in FIG. 6. As such, one of the pawls (depending upon the direction of rotation of the drive motor) is held in engagement with a tooth on a corresponding ratchet teeth to keep stepped gear 136 rotating about shaft 40. With the lever arms out of the path of the rollers 96, 98, the actuator arms 84, 86 will not be returned to the position of FIG. 5. The continual feeding of web 17 is useful when it is desired to make a copy of a particular segment thereof or if it is desired to quickly restack the web in one of the trays 18, 20. To stop the movement of the computer form web, the solenoid is deenergized to permit lever arms 104, 106 to reengage rollers 96, 98 of the actuator arms as shown in FIG. 5.

The drive mechanism 34 according to the invention is relatively simple in design and low cost yet provides an efficient drive for feeding computer form or fan fold webs and the like materials in a document feeder of the type described herein. The use of the drive mechanism is not, however, limited to that shown, but can be employed in other situations when a mechanism is required to provide incremental and/or continual rotational movement of a work piece both in forward and reverse directions.

What we claim is:

1. A mechanism for rotatably driving a gear member mounted on a support shaft for rotation thereon, including in combination: ratchet wheel means mounted on said support shaft for rotation thereon, said ratchet wheel means including first and second ratchet teeth sets extending circumferentially thereabout, the teeth of said sets facing in opposite directions, means coupled to said ratchet wheel means for driving the latter rotatably on said shaft in either of one of a clockwise and counter-clockwise direction, coupling means mounted on said shaft for rotation thereon and being axially spaced from said ratchet wheel means, said gear member being joined to said coupling means for rotation therewith, first and second pawl means mounted for pivotal movement on said coupling means, each said pawl means extending outwardly from said coupling means toward a set of ratchet teeth of said ratchet wheel means, respectively, for cooperative engagement therewith, biasing means coupled to said pawl means for biasing the latter toward said respective ratchet teeth sets, pawl actuator means mounted on said coupling means for movement between first and second positions, said pawl actuator means being positioned for engagement with said first and second pawl means, said pawl actuator means holding said first and second pawl means out of engagement with said ratchet wheel means upon movement of said pawl actuator means to said first position and means normally in position for engagement with said pawl actuator means to maintain said last-mentioned means in said first position when said coupling means is in a predetermined position on said support shaft, said pawl actuator engaging means being selectively movable to a second position out of engagement with said pawl actuator means thereby permitting said first and second pawl means to be moved by said biasing means toward said ratchet teeth sets whereby, depending upon the direction of rotation of said ratchet wheel means, one of said pawl means engages a tooth of said corresponding ratchet teeth set to couple said gear member to said ratchet wheel means for rotational movement therewith on said shaft.

2. A drive mechanism as claimed in claim 1 wherein said pawl actuator engaging means includes a stop portion engageable by said pawl actuator means as the latter are revolved about said shaft in response to the rotation of said coupling means to said predetermined position, said stop portion engaging said pawl actuator means to move the latter from said second to said first position thereby causing said pawl actuator means to urge said first and second pawl means away from said respective ratchet teeth sets, whereby said gear member is decoupled from said ratchet wheel to prevent further rotation of said gear member about said shaft.

3. A drive mechanism as claimed in claim 1 wherein said coupling means include a plate mounted for rotation on said support shaft, said first and second pawl means being mounted for pivotal movement on said plate, and wherein said pawl actuator means include first and second actuator arms, each mounted for pivotal movement on said coupling plate adjacent said pawls, a first end of each of said actuator arms extending outwardly from said plate for engagement with a respective one of said pawls, the opposite ends of said actuator arms extending outwardly from said plate for engagement by said engaging means when said coupling plate is in said predetermined position on said support shaft, said engaging means, when in a first position, engaging said opposite ends of said actuator arms to maintain said arms in a first position, whereby the first ends of said arms are positioned to hold said pawls against said biasing means, out of engagement with said ratchet teeth sets and upon disengagement of said opposite ends of said arms by said engaging means, permitting said pawls to be moved toward said ratchet teeth means for engagement therewith, whereby said actuator arms are pivoted to said second position.

4. A drive mechanism as claimed in claim 3 wherein said engaging means include first and second lever arms each mounted at a first end for pivotal movement thereabout, each of the opposite ends of said lever arms being movable between said first and second positions and including biasing means for biasing said lever arms to said first position for engagement with a respective one of said opposite ends of said pawl actuator arms when said coupling plate is in said predetermined position for maintaining the last-mentioned arms in said first position and means connected to said lever arms for pivoting the latter to move said opposite ends thereof, respectively, from the first to a second position against said biasing means.

5. A drive mechanism as claimed in claim 4 wherein each of said opposite ends of said lever arms includes a stop portion, when said lever arms are in said first position, the stop portion of one of said lever arms engaging an opposite end of a respective actuator arm upon rotating said coupling plate to said predetermined position, thereby moving said actuator arms from the second to a first position for moving the engaged one of said pawls out of engagement with a respective ratchet teeth set, whereby the rotation of said coupling plate is discontinued at said predetermined position.

6. A drive mechanism as claimed in claim 5 wherein said actuator arms are coupled together for simultaneous pivotal movement when one of said arms is pivoted, wherein upon rotating said coupling plate toward said predetermined position, an opposite end of a first one of said actuator arms first engages the second of said first and second lever arms pivoting the last-mentioned lever arm against said biasing means out of the path thereof and thereafter engages the stop portion of the first lever arm, whereby both said actuator arms are pivoted to said first position, said second lever arm thereby returning to a first position for engagement at the stop portion thereof by the opposite end of said second actuator arm for discontinuing the rotation of said coupling plate at said predetermined position.

7. In a form feeder device used for feeding segmented webs of material between first and second stations to the platen of a copying machine for the production of copies thereof, including a copyboard overlying the copy platen along which the form is fed, having a transport mechanism engageable with the form for conveying the latter along said copyboard, said transport mechanism being driven by a rotatable drive shaft, a mechanism for driving said drive shaft rotatably thereby to transport said form along said copyboard to the platen, said drive mechanism including in combination:

a support shaft, ratchet wheel means mounted on said support shaft for rotation thereon, said ratchet wheel means including circumferentially thereabout, first and second ratchet teeth sets, said teeth sets facing in opposite directions, means coupled to said ratchet wheel means for driving said ratchet wheel means in either of one of a clockwise and counter-clockwise direction, a drive member mounted on said support shaft for rotation thereon, said drive member being coupled to the drive shaft of said form feeder transport mechanism to provide rotational drive thereto, means mounted on said support shaft for coupling said ratchet wheel means and said drive member for rotatable movement on said support shaft, said coupling means being rotatably mounted on said shaft and joined to said drive member for rotation therewith, first and second pawls pivotally mounted on said coupling means, said pawls extending outwardly therefrom toward respective ratchet wheel teeth sets for cooperative engagement therewith, pawl actuator means mounted for movement between first and second positions on said coupling means, said actuator means engaging said pawls when in said first position for holding the latter out of engagement with said ratchet teeth sets and releasing said pawls for engagement with said ratchet teeth sets upon movement of said actuator means to said second position, and means for engaging said actuator means when said coupling means is in a first rotational position on said support shaft, said engaging means being movable between first and second positions for controlling the movement of said pawl actuator means between said first and second positions, said pawl actuating means being released for movement to said second position in response to the movement of said engaging means to said second position thereby releasing said pawls for engagement with said ratchet teeth sets, respectively, whereby, depending upon the direction of rotation of said ratchet wheel means, one of said pawls engages a tooth on a respective ratchet teeth set to couple said drive member to said ratchet wheel means for rotational movement on said shaft.

8. A drive mechanism as claimed in claim 7 wherein said engaging means include stop portion means engageable by said pawl actuator means with said engaging means in said first position when said coupling means is rotated to said first rotational position on said support shaft, said stop portion means engaging said pawl actuator means as the latter is revolved about said support shaft in accordance with the rotation of said coupling means, to move said pawl actuator means to said first position thereby urging said pawls away from said respective ratchet teeth sets for decoupling said drive member and rotating ratchet wheel means.

9. A drive mechanism as claimed in claim 7 wherein said pawl actuator means includes first and second pawl actuator arms, each mounted on said coupling means for pivotal movement adjacent said pawls, a first end of each of said pawl actuator arms extending outwardly in a first direction for engagement with a respective one of said pawls, the opposite end of each of said pawl actuator arms extending in a different direction for engagement by said engaging means, the latter upon movement to a first position, when said coupling means is rotated to said first rotational position in said support shaft, engaging said opposite ends to hold said pawl actuator arms in a first pivotal position, whereby the first ends of said arms are positioned to hold said pawls out of engagement with said ratchet teeth sets, and upon disengagement of said opposite ends of said arms by said engaging means, said arms being moved to a second position thereby permitting said pawls to be moved toward said ratchet teeth sets.

10. A drive mechanism as claimed in claim 9 wherein said pawls are mounted for pivotal movement on said coupling means and wherein said mechanism further includes biasing means for biasing said pawls toward said ratchet teeth sets, said biasing means moving said pawls toward said ratchet teeth sets upon movement of said engaging means to said second position, said pawls thereby urging said pawl actuator arms to said second position.

11. A drive mechanism as claimed in claim 10 wherein said engaging means include first and second lever arms each mounted at a first end for pivotal movement thereabout, each of the opposite ends of said first and second lever arms being pivoted between first and second positions, and including biasing means for biasing said lever arms to said first positions for engagement with a respective one of the opposite ends of said pawl actuator arms when said coupling means is rotated to said first position on said support shaft and means connected to said lever arms for moving the latter from the first to the second position against said biasing means.

12. A drive mechanism as claimed in claim 7 wherein said drive member includes a stepped gear member having first and second diameter gears included thereon, wherein said drive shaft includes a pinion mounted thereon and wherein said drive mechanism further includes an intermediate gear assembly including a support member mounted for movement between first and second positions and first and second idler gears being of the same diameter mounted on said support member for independent rotation thereon, the first and second idler gears being in meshing engagement with the first and second diameter gears of said stepped gear, respectively, one of said first and second idler gears being movable into engagement with said pinion upon movement of said support member to said first position and the other of said idler gears being movable into meshing engagement with said pinion upon movement of said support member to said second position, whereby, depending upon the position of said support member, said segmented web is driven a corresponding predetermined distance along said copyboard for each revolution of said stepped gear member.

13. A mechanism for coupling a first member mounted on a support shaft for rotation to a second member mounted on said support shaft and driven rotatably in either of one of a clockwise and counterclockwise direction, said second member having first and second oppositely facing ratchet teeth sets provided circumferentially thereabout, said mechanism including in combination:

a coupling member mounted on said support shaft for rotation thereabout, said coupling member being joined with said first member for rotation on said shaft therewith and including first and second pawls pivotally mounted thereon for movement toward and away from respective ratchet teeth sets on said second member, means for biasing said pawls toward said ratchet teeth sets;

pawl actuator means mounted on said coupling member movable between first and second positions, said pawl actuator means engaging said first and second pawls when said pawl actuator means is in said first position for holding said pawls out of engagement with said ratchet teeth sets, respectively, and means mounted adjacent said coupling member movable to a first position for engagement with said pawl actuator means for holding the latter in said first position when said coupling member is in a first rotational position on said support shaft, thereby maintaining said pawls out of engagement with said ratchet teeth sets, said holding means being movable from said first to a second position, to release said pawl actuator means for movement to said second position thereby releasing said pawls for movement by said biasing means toward said ratchet teeth sets, respectively, whereby, depending upon the direction of rotation of said second member, one of said pawls engages a tooth on a respective ratchet teeth set thereof to couple said first member to said second member for rotational movement therewith about said shaft.

14. A drive mechanism as claimed in claim 13 wherein said coupling member includes a plate mounted on said support shaft for rotation thereon, wherein said first and second pawls are mounted on said plate in opposing relation with respect to each other, wherein said pawl actuator means include first and second arms each mounted for pivotal movement on said coupling plate, first ends of said arms being positioned for engagement with said pawls, respectively and the opposite ends of said arms extending outwardly from said plate for engagement by said pawl actuator engaging means when said coupling plate is in said first rotational position on said support shaft, said pawl actuator engaging means, when in a first position, engaging the opposite ends of said pawl actuator arms to hold the latter in a first pivotal position, whereby first ends of said arms engage said pawls to hold the latter against said biasing means out of engagement with said ratchet teeth sets, and upon moving said pawl actuator engaging means to a second position, releasing said pawl actuator arms to permit said biasing means to move said pawls toward said ratchet teeth sets for engagement of one of said pawls with a respective ratchet teeth set thereby to couple said first and second members for rotation on said support shaft.

15. A drive mechanism as claimed in claim 14 wherein said pawl actuator engaging means includes a pair of lever arms, each mounted for pivotal movement at a first end thereof adjacent said coupling plate, the opposite ends of said lever arms being movable to first positions for engagement with respective ones of said first and second arms of said pawl actuator means, each of said lever amrs including a stop portion for engaging a respective one of said first and second pawl actuator arms when said coupling plate is rotated to said first rotational position on said support shaft, to move said actuator arms to said first position for disengaging said one pawl and ratchet teeth set, thereby to discontinue the rotation of said coupling plate and said first member on said support shaft.

* * * * *